US006112568A

United States Patent [19]

Lindstrom

[11] Patent Number: 6,112,568

[45] Date of Patent: Sep. 5, 2000

[54] ROLL FORMING USING TURRET PUNCH PRESS

[75] Inventor: Mikko Lindstrom, South Barrington, Ill.

[73] Assignee: Finn-Power International, Inc., Schaumburg, Ill.

[21] Appl. No.: 09/243,829

[22] Filed: Feb. 3, 1999

[51] Int. Cl.[7] ..... B21D 5/08

[52] U.S. Cl. ..... 72/179; 72/226; 72/452.9; 72/472

[58] Field of Search ..... 72/179, 182, 226, 72/452.1, 452.8, 452.9, 472; 29/36, 39; 83/552

[56] References Cited

U.S. PATENT DOCUMENTS

| | | | |
|---|---|---|---|
| 2,905,031 | 9/1959 | Appel | 72/452.8 |
| 5,107,695 | 4/1992 | Vandenbroucke | 72/179 |
| 5,156,034 | 10/1992 | Lorbach | 72/226 |
| 5,377,519 | 1/1995 | Hayashi | 72/326 |
| 5,450,740 | 9/1995 | Lovinggood | 72/226 |
| 5,555,759 | 9/1996 | Rosene | 72/179 |
| 5,575,168 | 11/1996 | Rosene | 72/179 |
| 5,761,945 | 6/1998 | Vandenbroucke | 72/176 |
| 5,787,775 | 8/1998 | Stevens | 83/552 |
| 5,937,694 | 8/1999 | Mueller | 72/452.8 |

*Primary Examiner*—Daniel C. Crane
*Attorney, Agent, or Firm*—Louis Woo

[57] ABSTRACT

To roll form a worksheet by a turret punch press, at least one pair of coacting tools are mounted to the opposed turrets so that when those tools are rotated to the work location, they could be driven to a predetermined relative distance towards each other to make contact with the workpiece. The depth of the formed shape is determined by the relative distance the coacting tools are driven towards each other. By moving the worksheet at the same time that the coacting tools are making contact with the worksheet, roll forming of the worksheet is effected. By providing the coacting tools in the opposing indexing stations and synchronously rotating those stations, a complex pattern can be roll formed on a worksheet. For those patterns that have different depths, the instant invention turret punch press can either continuously adjust the relative distance between the tools as the worksheet is being moved to effect the different depths, or use different sets of tools that, when moved to the appropriate relative distance, can actually effect different depths on the worksheets. Alternatively, a number of passes can be effected on the worksheet by the same set of tools, with the tools being readjusted to form a given depth for each of the various passes. Another embodiment of the instant invention utilizes a pair of tool units each of which includes a plurality of in alignment tools that can coactingly rotate along the opposed surfaces of the worksheet to effect roll forming.

31 Claims, 3 Drawing Sheets

ROLL FORMING USING TURRET PUNCH PRESS

FIELD OF THE INVENTION

The present invention relates to roll forming and specifically to using a turret punch press for performing roll forming.

BACKGROUND OF THE INVENTION

Until the instant invention, roll forming is usually done by a rolling mill that gradually forms a flat strip of material, preferably metal, until a final shape is obtained. There are two types of roll forming mills: an outboard type and an inboard type. To operate either type of roll forming mills, there needs to be positioned in front of the roll forming mill a prepunched press feeder that feeds the strip of material stored in an uncoiler. Once an appropriate section of the strip has been roll formed by going through the roll forming mill, it has to be straightened by a straightener and feed to a cut-off press, where the strip is cut.

Therefore, prior to the instant invention, roll forming requires a strip of material to be rolled through a forming mill. Accordingly, roll forming was not done by using a turret punch press.

SUMMARY OF THE INVENTION

To enable a turret punch press to roll form a worksheet, special coacting units are fitted to the corresponding bores of the opposing turrets of a punch press. The turret punch press may be a Finn-Power E5 "e" type punch press, which can control very precisely the relative distance between the two units. The units in turn each comprise a wheel, or a v-shaped or counter v-shaped tool, that coacts against the tool of the opposing unit, upon actuation by the respective impacting mechanisms of the units. The units, in unison, can be rotated to different orientations so that a contoured shape can be roll formed onto the worksheet. By using different sets of coacting tools and by carefully controlling the relative distance between the tools, other types of operations in addition to roll forming may also be effected. Examples of such operations include the forming of a bar code pattern on the worksheet, the effecting of a "shaker" cut line on the worksheet, and possibly the cutting of a portion off from the worksheet. All of these operations can be effected by continuously regulating the relative distance between the opposing tools.

Instead of using the same tool and adjusting the relative distance between the tools for roll forming a shape on the worksheet, another embodiment of the instant invention uses opposing units each of which has a number of rotatable tools, such as wheels of different diameters. Thus, instead of having to continuously readjust the relative distance between the tools, a single run through by the opposing plurality of wheels is all that is needed to effect the appropriate roll forming on the worksheet. The coacting units of the second embodiment each likewise are rotatable or indexable so that when the coacting units are synchronously rotated, a shape having different orientations could also be roll formed by those units.

The main objective of the instant invention is therefore to utilize a turret punch press for effecting roll forming on a worksheet.

Another objective of the present invention is to eliminate the need to have a strip of material being constantly fed to a particular type of machine in order to effect roll forming.

It is still another objective of the instant invention to effect other types of forming on the worksheet without having to reconfigure a turret punch press.

It is yet another objective of the instant invention to roll form individual worksheets.

BRIEF DESCRIPTION OF THE FIGURES

The above-mentioned objectives and advantages of the present invention will become apparent and the invention itself will best be understood by reference to the following description of an embodiment of the invention taken in conjunction with the accompanying drawings, wherein.

DETAILED DESCRIPTION OF THE INVENTION

Figure 1:
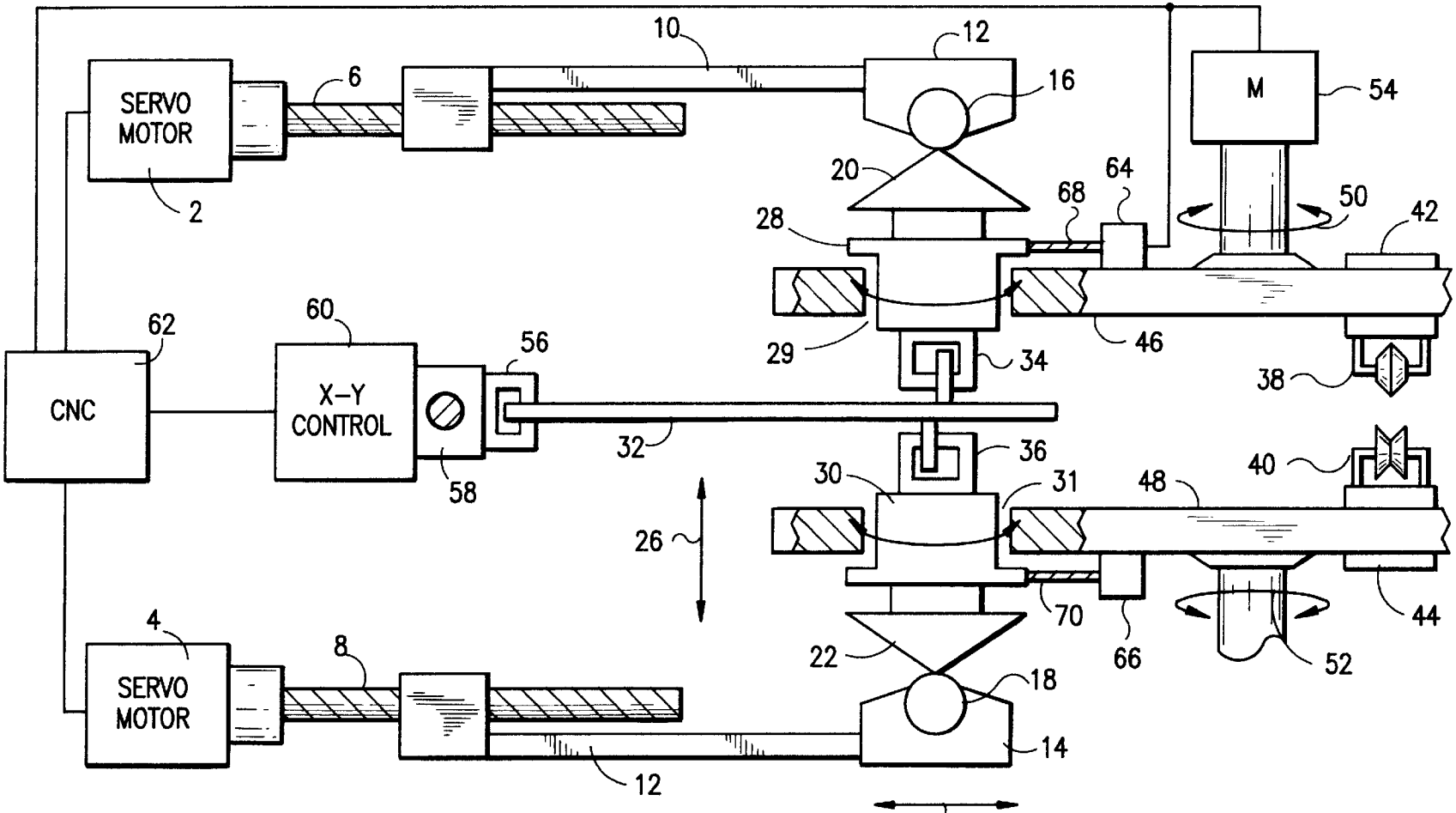
FIG. 1 is a simplified schematic of the instant invention.

FIG. 1 illustrates in simplified format the essential elements of the turret punch press of the instant invention. As was noted earlier, the turret punch press of the instant invention may be an "e" series Finn-Power work center, some portions of which are described in detail in application Ser. No. 09/056,776 filed Apr. 8, 1998, now U.S. Pat. No. 6,021,658 and application Ser. No. 09/174,576 filed Oct. 19, 1998. The respective specifications of the '776 and '576 applications are incorporated by reference herein.

In brief, as disclosed in the aforenoted applications, the "e" type turret punch press has a driving mechanism that comprises two servomotors 2 and 4 for rotating two threaded shafts 6 and 8, respectively. Threadedly mated to shafts 6 and 8 are rods 10 and 12, respectively, to the ends of which are mounted corresponding drive mechanisms 12 and 14. Mounted to drive mechanisms 12 and 14 are corresponding rollers 16 and 18, which are in contact with top portions (or rams) 20 and 22, respectively, of the tool units. Given the particular shape of rams 20 and 22, as drive mechanisms 12 and 14 are driven along the directions as indicated by directional arrows 24, rams 20 and 22 each are driven in a direction perpendicular to that of arrows 24, as for example per the directions indicated by directional arrows 26.

As shown in FIG. 1, rams 20 and 22 are respectively coupled to tool holders 28 and 30. As is well known, fitted within tool holders 28 and 30 are tools that are used to effect fabrication on a worksheet, such as for example 32 shown in FIG. 1. For the exemplar embodiment shown in FIG. 1, the work tools connected to holders 28 and 30 comprise rotating wheels 34 and 36, respectively. Although wheels are shown for tool 34 and 36, it should be appreciated that other types of tools that coact with each other for fabricating a worksheet could be used in place of the wheels. One such example is the v-shaped and counter v-shaped coacting rotating tools 38 and 40 shown coupled to corresponding bases 42 and 44.

As further shown in FIG. 1, the tool units, represented by holders 28 and 30, are each mounted to a corresponding bore in one of the opposed turrets 46 and 48 of the turret punch press. Similarly, the other shown coacting tool units, as represented by holders 42 and 44, are mounted to opposed turrets 46 and 48, respectively. Although only two sets of coacting tool units are shown, it should be appreciated that in a typical turret punch press, there are a number of sets of coacting tool units mounted along the respective peripheries of the opposed turrets, so that as the turrets are driven to rotate as shown by the rotational arrows 50 and 52 by drive mechanisms such as motor 54, each tool set would remain opposed to each other. Thus, as shown in FIG. 1, tool units 28 and 30 are driven to remain opposed to each other at the work location, whereat the tools are placed under the respective rams 20 and 22.

As further shown in FIG. 1, grasping worksheet 32 are a number of clamps, represented by clamp 56. As clamps 56 are mounted to a carriage 58 which is mounted to the frame of the turret punch press, clamps 56 are movable along the direction into and out of the paper. Carriage 58 in turn is mounted to drive mechanisms which allows carriage 58 to be moved along the direction indicated by directional arrows 24. As a consequence, with control from the x-y controller 60, clamps 56, acting as holders that grasp worksheet 32, can move worksheet 32 along both the x and y directions, as well as any combinations thereof.

Servomotors 2 and 4, as well as x-y controller 60, are all connected to a computerized numerical controller CNC 62. By monitoring the encoded signals from servomotors 2 and 4, the threaded shafts 6 and 8 can be precisely rotated, thereby accurately moving drive shafts 10 and 12 to control the movement of drive mechanisms 12 and 14, respectively. The distance that rams 20 and 22 can be driven can therefore be accurately controlled. Putting it another way, the relative distance between tools 34 and 36 can be precisely controlled so that, as those tools are moved to contact worksheet 32, the depth of forming that is effected on worksheet 32 by those tools is precisely controlled.

Further with respect to FIG. 1, note that holders 28 and 30 each are freely rotatable about their respective bores 29 and 31. To rotate holders 28 and 30, and therefore tools 34 and 36, in a synchronized matter, an indexing mechanism, shown in the FIG. 1 embodiment to comprise servomotors 64 and 66, is used. Connected to servomotors 64 and 66 are respective threaded shaft 68 and 70 that meshingly mate with holders 28 and 30, respectively. As a consequence, by controlling the operations of servomotors 64 and 66 in a synchronized manner, holders 28 and 30 are rotated synchronously to turn tools 34 and 36 in the same orientation at the same time for effecting forming on worksheet 32. And as worksheet 32 is grasped by clamps 56 and is moved thereby, a true roll forming is effected on worksheet 32 when tools 34 and 36 are moved relative to each other a predetermined distance to contact worksheet 32. The operation of the indexing station and the synchronous rotation of the tool are given in greater detail in the disclosure of U.S. Pat. No. 5,787,775, issued to the assignee of the instant invention. The disclosure of the '775 patent is incorporated by reference herein.

Figure 2:
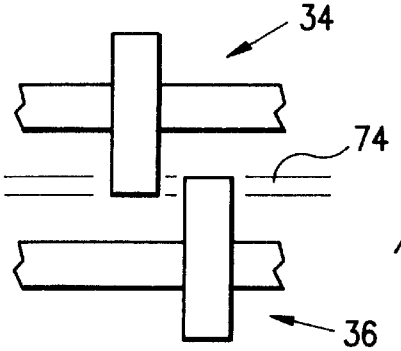
FIG. 2 is a cross-sectional view of two coacting wheels of the instant invention used for roll forming.
Figure 4:
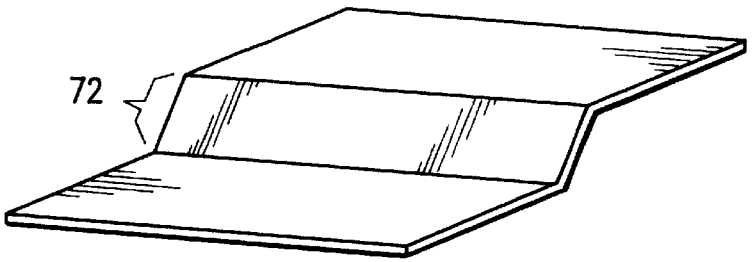
FIG. 4 illustrates a worksheet, or a portion thereof, that has been formed by a pair of rotating tools such as the coacting wheels of FIGS. 2 and 3.

FIG. 2 illustrates the coacting relationship between a pair of wheels that are used to roll form a worksheet. Such roll formed worksheet, or at least a portion thereof, is shown in FIG. 4. Note that depth 72 of the worksheet shown in FIG. 4 corresponds to the relative distance 74 separating tools 34 and 36.

Figure 3:
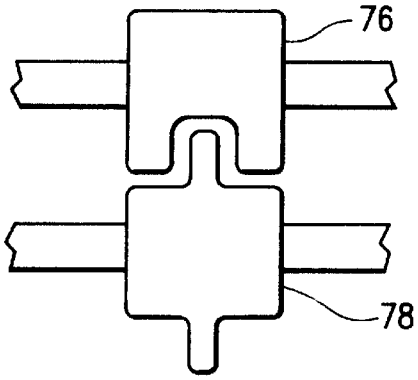
FIG. 3 is another embodiment of two coacting wheels used in the instant invention.
Figure 5:
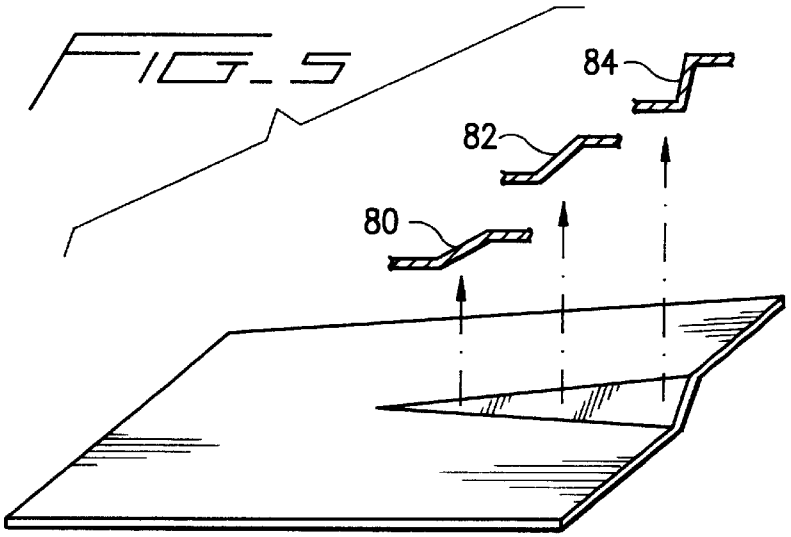
FIG. 5 illustrates a worksheet with a graduated formed shape accomplished by using the same set of tools set at different relative distance.

Another exemplar pair of coacting rotating tools is illustrated in FIG. 3. In particular, FIG. 3 shows a pair of coacting wheels 76 and 78 which, when moved to various relative distances therebetween, can effectively produce the kind of formed shape as shown in the worksheet of FIG. 5. Specifically, when roll forming begins, the shape that is illustrated, in cross-sectional view 80, is first achieved by wheels 76 and 78 (or wheels 34 and 36) being positioned relatively far from each other. Thereafter, either by means of a second pass of wheels 76 and 78 over the same formed portion of the worksheet, a more graduated forming is formed. This is illustrated for example by the second cross-sectional view 82 whereby wheels 76 and 78 (or wheels 34 and 36) have been moved closer relative to each other. Finally, with wheel 76 and 78 (or wheels 34 and 36) being positioned at their relatively closest distance, the final forming, as illustrated by cross-sectional view 84, is effected.

As a consequence, as shown by the roll formed configuration of the worksheet shown in FIG. 5, a graduated continuously increasing roll forming is effected. Note that the number of times that the coacting wheels have to pass the formation in order to effect the desired pattern is dependent on how complex and how many different depths the desired shape has. Also, with the "e" type machine of the instant invention, given that the relative distance between the tools can be continuously adjusted by the movement of driving mechanisms 12 and 14, instead of a number of passes over the same formation to effect the desired shape, it is possible that the relative distance separating the coacting tools can be continuously adjusted while the worksheet is moved so that only one pass is required for effecting the desired formation.

Figure 7:
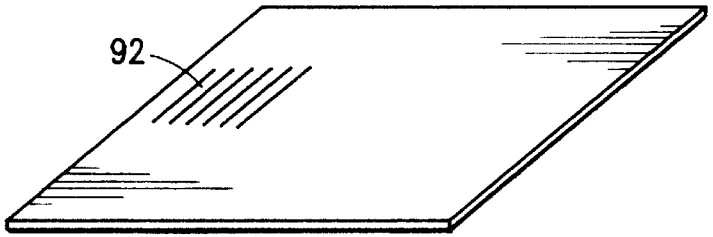
FIG. 7 illustrates a bar code pattern formed with either of the tools, or equivalents thereof, shown in FIGS. 3 and 6.
Figure 6:
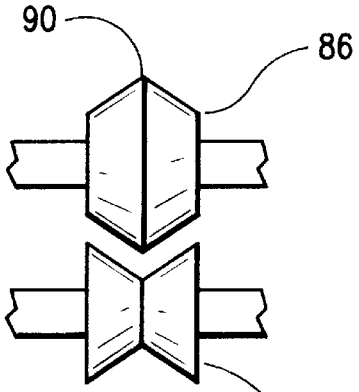
FIG. 6 is a cross-sectional view of a pair of v-shaped and counter v-shaped tools.

FIG. 6 shows yet another set of coacting tools. In this instance, the tool set comprises a v-shaped rotating tool 86 and a counter v-shaped rotating tool 88. Given that wheel 86 has a sharp edge at 90, very fine forming or cutting can be effected on the worksheet. For as illustrated in the worksheet of FIG. 7, by passing tools 86 and 88 a number of times over the worksheets, a bar code pattern 92 can be formed on the worksheet. Such bar code pattern may comprise for example a given number of lines within a given measured space for providing intelligence. For instance, if a bar code pattern is separated into a number of sections each having a width of 1 cm, the number of lines that are contained within each centimeter could provide the intelligence. For example, 5 equally spaced lines within 1 cm could mean an A, 6 equally spaced lines within a centimeter a B, and 5 non-equally spaced lines within a centimeter a C, etc.

Figure 8:
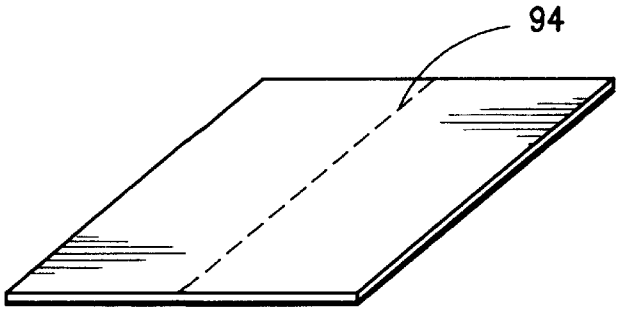
FIG. 8 illustrates a worksheet having formed thereon a shaker cut line that would enable the worksheet to be easily broken apart along the line with minimal force.

FIG. 8 shows another forming that could be effected by the coacting tools shown in FIG. 6. The dotted line 94 shown in the worksheet of FIG. 8 is an illustration of a "shaker" cut line that allows the worksheet to be easily broken along the length of the line. Such shaker cut line is effected by cyclically and continuously varying the relative distance between tools 86 and 88 as the worksheet is moved.

Figure 9:
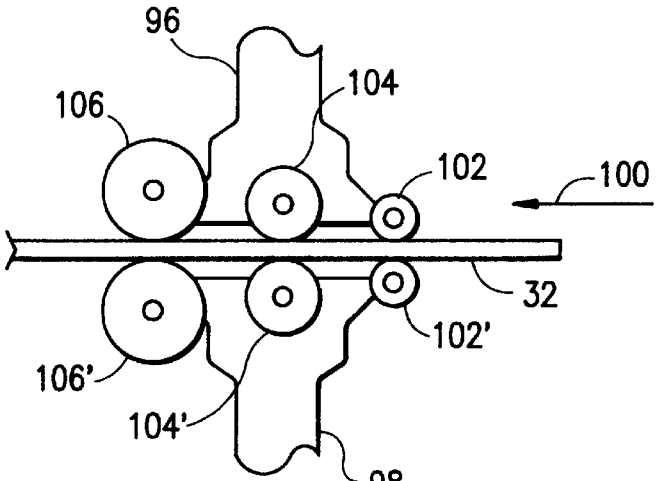
FIG. 9 is a side view of a set of tools of the instant invention each of which has a plurality of rotatable tools, such as wheels that have different diameters for effecting for example the kind of formed shape shown in FIG. 5 without having to have the relative distance between the opposing tools readjusted for different depths.

FIG. 9 is a side view illustration of a set of coacting tools 96 and 98 each of which has a plurality of in alignment rotating tools mounted thereon. Although not limited to such, three wheels of different diameters are shown to be attached to each of the tools. As the worksheet 32 is moved in the direction illustrated by the direction arrow 100, it first makes contact with the pair of wheels 102 and 102', so as to begin the first forming. A greater depth is effected when the portion of worksheet 32 that has been formed by wheels 102 and 102' is roll formed by wheels 104 and 104'. Even greater depth is formed on worksheet 32 when that portion of the worksheet is reached and pressed by coacting wheels 106 and 106'. In essence, a graduated roll form pattern such as for example that shown in FIG. 5 is effected. Of course, other types of rotatable tools besides wheels may also be used as the tool unit of FIG. 9 for effecting different complex formations on a worksheet. Moreover, given that the tool holders are indexable, or rotatable, along a direction perpendicular to the direction of the rotational movement of the tools, a complex contoured pattern having different depths can be roll formed on a worksheet by the turret punch press of the instant invention.

In operation, when using a single set of opposed tools, after moving the tools, which presumably are rotatable along the opposed surfaces of the worksheet, to the desired predetermined relative distance into contact with the worksheet to effect forming, the worksheet is moved both along the x and y directions for effecting the forming of the worksheet. If the pattern to be formed is a complex pattern that has a single depth, then the opposed tools would be held in their relative distance while the worksheet is moved to form the desired pattern. However, if the pattern to be formed requires a number of different depths, with the instant invention, since the relative distance between the opposed tools can be precisely controlled, when a different depth is required, the opposed tools can either be moved closer towards or away from each other so that those tools would continue to rotate along the opposed surfaces of the worksheet for effecting the desired depth. This process can continue until the pattern having the desired depth(s) is roll formed on the worksheet.

On the other hand, it is also possible that the tools may be set at a predetermined relative distance to make a first pass over the worksheet. A second pass at the appropriate locations of the pattern with the tools having been moved to the requisite relative distance therebetween for effecting the desired depth can then take place. A third, a fourth, or other additional passes with different depths follow until the desired pattern with the desired number of depths is formed.

In the instance where a turret punch press other than the "e" type punch press of FIG. 1 is used, a number of sets of tools having different diameters may be needed. This is because in those machines other than the "e" type machine, the relative distance between the tools cannot be readily varied since the rams can be driven, for example hydraulically, a certain distance only. Thus, a plurality of sets of tools having various diameters are used. In that case, for the first pass through, a first set of tool that would create for example the type of cross-sectional view 80 as shown in FIG. 5 may be used. Thereafter, a second set of tools is rotated by the turrets into the work location to effect the kind of forming as shown for example by cross-section view 82. To effect the final forming, yet a third pair of tools is rotated by the turrets to the work location so that a forming such as for example the cross-sectional form 84 shown in FIG. 5 can be effected. Of course, the respective diameters of the three exemplar sets of tools are different from each other.

While a preferred embodiment of the present invention is disclosed herein for purposes of explanation, numerous changes, modifications, variations, substitutions and equivalents in whole or in part, should now be apparent to those skilled in the art to which the invention pertains. Accordingly, it is intended that the invention be limited only by the spirit and scope of appended claims.

What is claimed is:

1. In a punch press having opposed one and other turrets, holder means for grasping a to be fabricated worksheet placed between said one and other turrets and motor means for driving a drive means along a first direction, a method of effecting forming to said worksheet comprising the steps of:

a) fitting to said one turret one rotatable tool;

b) fitting to said other turret an other rotatable tool that operates cooperatively with said one tool;

c) controllably energizing said motor means to drive said drive means along said first direction to thereby drive at least one of said one and other tools along a second direction substantially perpendicular to said first direction so as to move said one and other tools to a predetermined distance relative to each other to effect forming on said worksheet; and d) driving said holder means to move said worksheet so as to cause said tools to respectively and coactingly roll along the opposite surfaces of said worksheet to thereby effect roll forming on said worksheet.

2. The method of claim 1, wherein each of said tools is further rotatable with respect to the longitudinal axis of said opposed one and other turrets; and wherein, when said worksheet is moved by said holder means, said tools are correspondingly rotated about said longitudinal axis so as to effect a forming pattern on said worksheet that has a nonlinear shape.

3. The method of claim 1, wherein said motor means comprises servo motor means and said drive means comprises a drive shaft, said method further comprising the step of:

controllably energizing said servo motor means to drive said drive shaft to an other distance along said first direction so as to move said one and other tools to an other predetermined distance from each other along said second direction so that forming of an other depth is effected on said worksheet.

4. The method of claim 3, further comprising the steps of:

e) repeating step c to move said one of said one and other tools to at least another predetermined distance relative to other of said one and other tools to effect an other forming on said worksheet; and f) repeating step d to drive said holder means to move said worksheet to effect an other roll forming on said worksheet;

whereby a roll formed shape having at least two different depths is effected on said worksheet.

5. The method of claim 4, further comprising the step of:

repeating steps e and f a plurality of times for roll forming a complex form having a plurality of depths or a graduated depth on said worksheet.

6. The method of claim 1, wherein said step a further comprises the step of fitting a tool have a v-shape to said one turret and said step b comprises the step of fitting a tool having a counter v-shape to said other turret; and wherein, depending on the distance relative to each other that said one and other tools are moved, said v-shaped and counter v-shaped tools cooperatively act against each other to form said worksheet, to bend said worksheet, to form a bar code pattern on said worksheet, to form a shaker cut line on said worksheet, or to cut said worksheet.

7. The method of claim 1, wherein said respective tools in said steps a and b are wheels that coact with each other to effect at least forming, bending, or cutting of said worksheet.

8. The method of claim 1, wherein said step of moving said one and other tools and said step of driving said holder means to move said worksheet are effected one before the other, one after the other, or simultaneously.

9. The method of claim 3, wherein said servo motor means comprises at least two servo motors and said drive means comprises a corresponding number of drive shafts; and wherein each of said servo motors drives a corresponding drive shaft along said first direction for independently driving one of said one and other tools relative to each other.

10. The method of claim 1, wherein said step c further comprises the step of:

controllably energizing said motor means to drive said drive means uni-directionally or bidirectionally along said first direction so as to vary the distance said one and other tools are being driven relative to each other along said second direction as roll forming is being effected on said work sheet by said one and other tools.

11. In a turret punch press having an upper turret and a lower turret each including a plurality of tools mounted peripherally thereabout, each of said plurality of tools being rotatable along two perpendicular axes, motor means for rotating said upper and lower turrets so that a first pair of upper and lower tools are positioned opposed each other at a work location, holder means for grasping and moving a worksheet placed between said first pair of upper and lower tools, an other motor means for driving a drive means to move said upper and lower tools, a method of effecting forming on said worksheet comprising the steps of:

a) energizing said other motor means to drive said drive means in a first direction to move said first pair of rotatable upper and lower tools in a second direction substantially perpendicular to said first direction a first distance towards each other to contact said worksheet;

b) moving said worksheet so that a first forming is effected on said worksheet by the respective rotations of said tools on the opposite surfaces of said worksheet;

c) energizing said other motor means to drive said drive means to move said upper and lower tools away from each other;

d) rotating said upper and lower turrets to position a second pair of upper and lower rotatable tools at said work location;

e) energizing said other motor means to drive said drive means in said first direction to move said second pair of rotatable upper and lower tools in said second direction towards each other an other distance to contact said worksheet;

f) moving said worksheet so that an other forming is effected on said worksheet, said other forming having a different depth than said first forming; and g) repeating said steps d to f until a formed shape having all the required depths is completed on said worksheet.

12. The method of claim, 11, wherein said driving said rotatable upper and lower tools steps each further comprise the step of:

rotating said upper and lowertools in a coacting fashion about a direction perpendicular to the surfaces of said worksheet as said upper and lower tools are each rotating along the respective opposite surfaces of said worksheet to thereby form a contoured shape on said worksheet.

13. The method of claim 11, wherein said other motor means comprises at least two servo motors and said drive means comprises at least two drive shafts; and wherein each of said servo motors drives a corresponding one of said drive shafts along said first direction for driving a corresponding one of each pair of upper and lower tools positioned at said work location relative to the other of said each pair of upper and lower tools along said second direction.

14. The method of claim 11, wherein said first pair of upper and lower tools comprises a tool have a v-shape and a coacting tool having a counter v-shape; and wherein, depending on the distance relative to each other that said v-shaped and counter v-shaped tools are moved to cooperatively act against each other, said worksheet is effected to have any of a roll formed shape, a bent shape, a bar code pattern, a shaker cut line on said worksheet, or a cut worksheet.

15. The method of claim 11, wherein said respective pairs of tools are cooperative wheels that coact with each other to effect at least forming, bending or cutting of said worksheet.

16. The method of claim 10, further comprising the step of:

energizing said other motor means to drive said drive means uni-directionally or bidirectionally along said first direction so as to vary the distance said pairs of upper and lower tools are being driven relative to each other along said second direction as different forming operations are being effected on said work sheet by said pairs of upper and lower tools.

17. In a punch press having opposed one and other tool turrets, motor means for moving drive means along one direction, and holder means for grasping and moving a to be fabricated worksheet placed between said one and other turrets, a method of effecting forming to said worksheet comprising the steps of:

a) fitting to said one turret an unit having at least two in alignment rotatable tools each rotatable along the plane of said worksheet;

b) fitting to said other turret an other unit having at least two other in alignment rotatable tools that coact cooperatively with said two rotatable tools, said two other rotatable tools rotatable along the plane of said worksheet;

c) controllably energizing said motor means to move said drive means along said one direction to drive at least one of said one and other units to a predetermined distance relative to the other along an other direction perpendicular to said one direction to effect forming on said worksheet; and d) driving said holder means to move said worksheet so as to cause said two in alignment rotatable tools and said two other in alignment rotatable tools of said one and other units to respectively and coactingly roll along the opposite surfaces of said worksheet to thereby effect roll forming on said worksheet.

18. The method of claim 17, wherein said two in alignment rotatable tools and said two other in alignment rotatable tools are further rotatable as respective units with respect to the longitudinal axis of said opposed one and other turrets, and wherein, when said worksheet is moved by said holder means, said two and other two alignment rotatable tools are correspondingly rotated about said longitudinal axis so as to effect a forming pattern on said worksheet that has a nonlinear shape.

19. The method of claim 17, wherein said motor means comprises servo motor means and said drive means comprises a drive shaft, said method further comprising the step of:

controllably energizing said servo motor means to drive said drive shaft in said one direction to move at least one of said two in alignment rotatable tools or said other two in alignment rotatable tools to an other predetermined distance from each other along said other direction so that forming of an other depth is effected on said worksheet.

20. The method of claim 17, further comprising the steps of:

e) repeating step c to move one of said two in alignment rotatable tools or said two other in alignment rotatable tools to at least an other predetermined distance relative to the other of said two in alignment rotatable tools or said two other in alignment rotatable tools to effect an other forming on said worksheet;

f) repeating step d to drive said holder means to move said worksheet to effect another roll forming on said worksheet having at least two different depths; and g) repeating steps e and f a plurality of times for effecting a formed shape having a plurality of depths or a continuos graduated depth on said worksheet.

21. The method of claim 17, wherein said rotatable tools comprise wheels.

22. A punch press, comprising:

opposed one and other turrets;

holder means for grasping and moving a to be fabricated worksheet placed between said one and other turrets;

one rotatable tool fitted to said one turret;

an other rotatable tool that operates cooperatively with said one tool fitted to said other turret;

drive means for moving said one and other rotatable tools relative to each other along one direction; and motor means for driving said drive means along an other direction substantially perpendicular to said one direction, said motor means being controllably energized to drive said drive means to move at least one of said one and other tools to a predetermined distance relative to the other to effect forming on said worksheet;

wherein said holder means moves said worksheet so as to cause said tools to respectively and coactingly roll along the opposite surfaces of said worksheet to thereby effect roll forming on said worksheet.

23. The turret punch press of claim 22, wherein each of said tools is rotatable with respect to an axis perpendicular to said opposed one and other presses; and wherein, when said worksheet is moved by said holder means, said one and other tools are correspondingly rotated about said longitudinal axis so as to form a contoured pattern on said worksheet.

24. The turret punch press of claim 22, wherein said motor means comprises servo motor means for driving said drive means along said other direction for controllably moving at least one of said one and other tools to an other predetermined distance from each other along said one direction so that a roll formed pattern of an other depth or a graduated depth continuing from the earlier roll forming is effected on said worksheet.

25. The turret punch press of claim 22, wherein said motor means is energized to drive said drive means to move one of said one and other tools to at least another predetermined distance relative to the other of said one and other tools along said one direction to effect an other forming on said worksheet; and wherein said holder means is driven to move said worksheet to roll form a shape having at least two different depths on said worksheet.

26. Punch press of claim 22, wherein said drive means comprises a ram means having a portion that comes into contact with a driving roller being shaped to cause said one and other tools to move relative to each other at different distances along said one direction as said ram means is driven, uni-directionally or bidirectionally along said other direction, by said motor means.

27. Apparatus used with a turret punch press having upper and lower turrets for effecting roll forming on a worksheet, comprising:

at least one tool rotatable along one surface of said worksheet fittingly mounted to a bore of one of said upper and lower turrets;

at least an other tool rotatable along other surface of said worksheet fittingly mounted to a bore of other of said upper and lower turrets, said other tool working cooperatively with said one tool;

drive means for moving said one and other tools relative to each other along one direction;

motor means for driving said drive means along an other direction to thereby move said one and other tools along said one direction;

wherein, when said one and other rotatable tools are moved to respective positions relative to each other to rotate along said respective one and other surfaces of said worksheet as said worksheet is moved, said worksheet is effectively roll formed by said one and other rotatable tools to have a desired formed shape.

28. Apparatus of claim 27, wherein said one and other tools each are rotatable about the longitudinal axis of said bores as well as rotatable along the corresponding surface of said worksheet so that each said tool is drivable to rotate about said longitudinal axis as it effects forming on said corresponding surface of said worksheet to effect a contoured forming thereon.

29. Apparatus of claim 27, further comprising:

one base to which said one tool is coupled, said one base being fittingly mounted to said bore of said one turret; and other base to which said other tool is coupled, said other base being fittingly mounted to said bore of said other turret.

30. Apparatus of claim 24, wherein said one base has a first plurality of tools in alignment with each other, each of said first plurality of tools rotatable along said one surface of said worksheet; and wherein said other base has a second plurality of tools in alignment with each other, each of said second plurality of tools rotatable along said other surface of said worksheet.

31. Apparatus of claim 30, wherein at least one of either of said first or second plurality of tools has a circumference different from at least another of said either plurality of tools so that as said worksheet is being moved and said respective first and second plurality of tools rotate along said one and other surface of said worksheet, a configuration having varying depths is formed on said worksheet as said first plurality of tools work cooperatively against said second plurality of tools.

* * * * *